United States Patent [19]

Viio

[11] Patent Number: 4,809,894

[45] Date of Patent: Mar. 7, 1989

[54] DEVICE FOR DETACHABLY CONNECTING OBJECTS TO AN ARTICLE OF CLOTHING

[76] Inventor: Matti Viio, P.O. Box 563 (Bäckvägen 17), 191 05 Sollentuna, Sweden

[21] Appl. No.: 928,977

[22] Filed: Nov. 10, 1986

[30] Foreign Application Priority Data

Jan. 24, 1986 [SE] Sweden ..... 8600305

[51] Int. Cl.[4] ..... A45F 5/02

[52] U.S. Cl. ..... 224/248; 224/251; 224/269; 224/904; 248/302; 248/309.1

[58] Field of Search ..... 224/904, 269, 191, 247, 224/248, 251, 268, 904; 248/231.8, 302, 309.1, 359

[56] References Cited

U.S. PATENT DOCUMENTS

| | | | |
|---|---|---|---|
| 510,835 | 12/1893 | Blair | 248/231.8 |
| 1,188,147 | 6/1916 | Butler | 248/231.8 |
| 1,196,737 | 8/1916 | Hammond | 248/231.8 |
| 1,707,120 | 3/1929 | Gordon | 248/231.8 |
| 4,321,755 | 3/1982 | Illgen | 224/904 X |
| 4,457,462 | 7/1984 | Taormina | 224/904 X |

*Primary Examiner*—Werner H. Schroeder

*Attorney, Agent, or Firm*—Kane, Dalsimer, Sullivan, Kurucz, Levy, Eisele & Richard

[57] ABSTRACT

The present invention relates to a device for detachably securing objects to an article of clothing, such as a vest, jacket, trousers or corresponding garment. The device comprises a carrier part having a substantially horizontal support or carrier surface which merges with preferably parallel and mutually spaced upstanding limbs possessing resilient spring-like characteristics. The limbs form an angle with the carrier part and merge, distal from the carrier part, with respective arms, which form angles with the limbs and extend in mutually opposite directions. The arms are intended to coact detachably with loops, eyes, or functionally equivalent means provided on the item of clothing.

9 Claims, 2 Drawing Sheets

DEVICE FOR DETACHABLY CONNECTING OBJECTS TO AN ARTICLE OF CLOTHING

TECHNICAL FIELD

The present invention relates, in principle, to a device for detachably connecting objects to an article of clothing.

BACKGROUND PRIOR ART

The aforementioned technical field covers a wide number of areas. For example, all those who are engaged in handiwork, whether professional or not, are reliant upon a number of basic tools, which should be readily accessible in all conceivable working positions of the person concerned, although without impeding the movement of said person or preventing him/her from adopting certain working positions.

Within this latter area there has long been found articles of clothing which are particularly designed for specific types of work and which are provided with a number of pockets at various locations, for receiving and holding such items as pencils, rules, screwdrivers and other tools. The pockets provided in such garments are usually of a conventional form, which means that an elongated tool will often present an obstacle to the workman concerned, for example when wishing to take a different working position. In recent years, working garments have been introduced under the trade name "SNICKERS", inter alia in the form of vests provided with loosely hanging pockets which have proven to be of significant benefit to the user. The overall effectiveness of these garments together with the special models provided for different categories of workmen requiring the use of different tools has afforded the workman the possibility of having the tools required to effect the work on hand readily available. The Patent Literature concerned with this technical field also describes and illustrates other devices which enable tools to be reached readily, for example such devices as belts provided with loops and eyes of particular design. U.S. Pat. Nos. 3,294,298 and 4,523,702 describe and illustrate cassette-like devices which are intended to be strapped about the waist of the wearer, wherewith adjustable straps or belts form holders for different kinds of tools.

However, despite the usefulness of such auxiliary devices, areas are found in which they cannot be used with the degree of effectiveness required. Examples of such areas include activities such as mountain climbing, hunting and fishing. Each of these activities requires objects to be carried. An obvious expedient in this regard is the use of conventional rucksacks or hand-carried zip-fastener bags. Bait boxes—in the case of fishing - and hunting bags are also often carried by hand.

The object of the invention is to provide a versatile device of the kind described in the introduction. This object is achieved by the present invention which relates to a device for detachably connecting objects to articles of clothing, characterized in that the device comprises a carrier part having a substantially horizontal object-support or object-carrier surface which merges with preferably parallel and mutually spaced upstanding limbs possessing resilient, spring-like characteristics, the limbs forming an angle with the carrier part and merging, at an angle, with arms which extend in mutually opposite directions and which are intended to co-act detachably with loops, eyes or functionally equivalent means provided on said article of clothing.

A device thus formed can be used to hang a large variety of different objects at selected locations on the article of clothing, or garment concerned. The attachment means provided on the garment, i.e. the loops, eyes, or technically equivalent means can be located on the back of said garment when the object to be carried is suited herefor. A jacket, vest or other article of clothing may, for example, have attachment means, i.e. loops etc., located around the waist part thereof, so that the device according to the invention can be attached to the article of clothing at selected locations thereon.

As a result of this construction, the weight of the object , or objects, carried by the device is distributed substantially uniformly over the two arms. The advantage with this is that neither the attachment means (loops, etc.) nor the article of clothing concerned need be reinforced, and therefore relatively heavy objects can be carried without risk of damage to the clothing..

A further important advantage afforded by the invention is that the weight of the object carried by the device is centralized, so that the wearer will not become unbalanced.

Due to the fact that at least the limbs of the device possess resilient, spring-like properties, it is ensured that the device cannot be inadvertently loosened from the loops or like means.

It has been found that a suitable angle between the carrier part and the limbs is from 75°-100°, preferably about 90°, since the object carried by the device will then rest at a given distance from the body of the wearer, with no negative effects.

In a versatile object-supporting device according to the invention, the carrier part comprises a straight rod-like part which joins the limbs. The straight carrier part located between the limbs can be used directly, or via connecting elements for detachably connecting a wide variety of objects to said article of clothing.

In a further embodiment, the carrier part may have a circular arcuate configuration which presents an open circumferential section the extent of which determines the distance between the limbs, the carrier part thus formed extending away from the body of the wearer when the device is attached to said article of clothing.

Tools of various shapes and sizes can be detachably supported by the device, depending upon the size of the carrier part. The head of a hammer can rest against the upper surface of the part-circular carrier, as can also an electric drill or a screwdriver, It will be obvious to those skilled in this art that the carrier part of the device can be given many different configurations. It is important, however, that the angle between the arms and respective limbs lies between 75°-100°, preferably about 90°. In this way the device, when attached to said clothing, will hang pivotally therefrom, and due to the high location of the pivot axis the device will swing in response to movement of the wearer.

The device can be caused to conform to the body of the wearer, by bending the arms away from the carrier part.

To enable the device to be securely held between two mutually adjacent loops or functionally equivalent means, the free end portions of the arms can be bent downwards, so as to be firmly held in said loops.

The device according to the present invention is preferably manufacture from a single length of hard material, e.g. spring steel of round cross-section, bent in the aforedescribed manner, this method having been found to be the simplest and least expensive method. A device made of round rod has been found less wearing on the fabric of the garment at the locations where the device is attached.

Although the invention can be used in practice for a wide variety of purposes, it will be described hereinafter with reference to its use as a tool carrier. The examples given with regard to the areas in which the device can be used are not intended to limit the scope of the invention defined in the following claims.

A DESCRIPTION OF PREFERRED, NON-LIMITING EMBODIMENTS OF THE INVENTION

Figure 1:
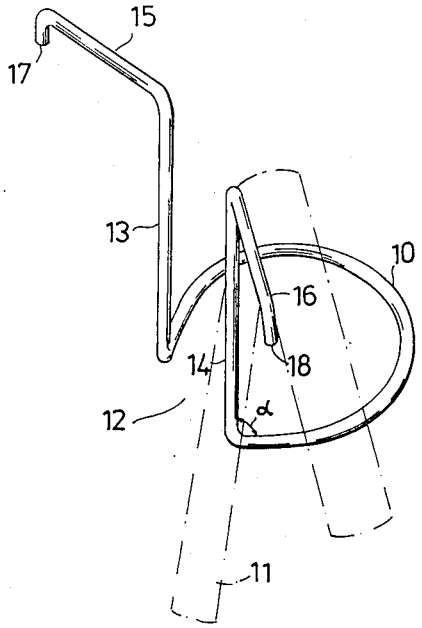
FIG. 1 is a perspective view of an embodiment of a device according to the invention.

The novel device for detachably connecting objects to an article of clothing, or garment, includes a base part 10 which forms a carrier part for an object 11, which in the illustrated embodiment is assumed to be a hammer. The carrier part 10 is part-circular in shape and when in the in-use position lies approximately in the horizontal plane. The part-circular shape of the carrier part 10 is such as to leave a circumferential sector 12 which is preferably open and which in said in-use position of the device faces towards the body of the user. It will be appreciated that the dimensions of the carrier part 10 and its particular configuration can be varied within wide limits, depending on the nature of the object to be carried or the shape of said object. Examples of variants of the carrier part are described hereinafter with reference to FIGS. 3, 4*a* and 4*b*.

Although the carrier part 10 of the illustrated embodiment is shaped to accommodate a particular object, it is always connected to or merges with two mutually spaced limbs 13, 14 which extend upwards at an angle $\alpha$75°–100°, preferably about 90° in relation to the plane of the carrier part 10. At least the limbs 13, 14 are manufactured from a material that has spring-like characteristics, such as spring steel for example. The limbs 13, 14 are connected to or merge with arms 15, 16 which extend in roughly mutually opposite directions and the free ends 17, 18 of which are bent to the shape illustrated in the drawings.

Figure 2:
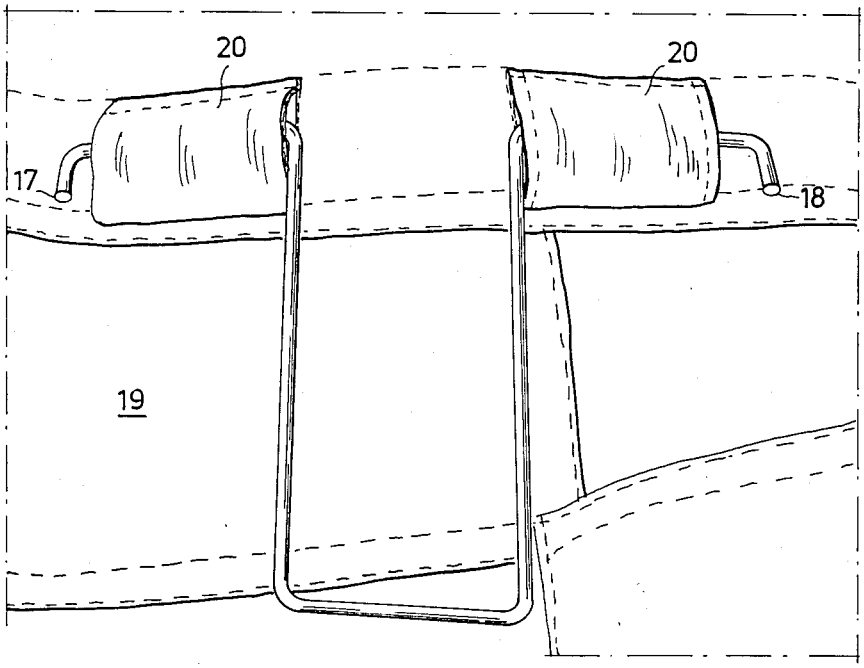
FIG. 2 illustrates how the device according to the invention is detachably secured to a garment.

The reference 19 in FIG. 2 identifies an article of clothing which is intended to be worn by the workman concerned. This article of clothing may have the form of a vest, a pair of trousers, overalls, a jacket or like garment. The clothing has provided at suitable locations thereon a number of loops or functionally corresponding means 20, which are attached to the garment in a known manner by top and bottom seams. The loops may be few in number or many. The loops 20, or functionally equivalent means are spaced at a mutual distance apart so that two mutually adjacent loops can serve as attachment means for the arms 15, 16 joined to the bendable, resilient limbs 13, 14. An arrangement according to the invention can be readily attached to the item of clothing 19, by manually pressing the resilient limbs 13, 14 together and then inserting the arms 15, 16 into respective loops of a pair of mutually adjacent loops or the like 20. The distance between the thus spring-biassed limbs 13, 14 and between said pair of loops is such that when the arms 15, 16 are inserted in respective loops the limbs 13, 14 will strive to return to their original relaxed state and therewith exert a force against the mutaully facing loop openings, thereby causing the bent end portions of the arms 15, 16 to be moved to a position outwardly of the opposite ends of respective loops or the like 20. The weight of an object carried by or resting against the carrier part 10 positions the arms 15, 16 in the bottom parts of the loops 20. Consequently, the loops or the like 20 form a pivot centre for the device according to the invention, such that the device will accompany the body movements of the wearer and adapt to the body positions taken thereby. The novel device according to the invention therefore presents no obstacle in these latter respects. The orientation of the carrier part 10 in relation to the sprung limbs 13, 14 and the direct connection of the carrier part with the limbs 13, 14 means that the weight of an object carried by the carrier part 10 is distributed substantially uniformly on the arms 15, 16.

The device according to the invention is preferably produced by bending a single length of hard material which exhibits resilient, spring-like characteristics, e.g. spring steel, to the shape described and illustrated. Excessive rapid wear to the loops 20 or the like is avoided when the length of material used has a round cross-section.

Figure 3:
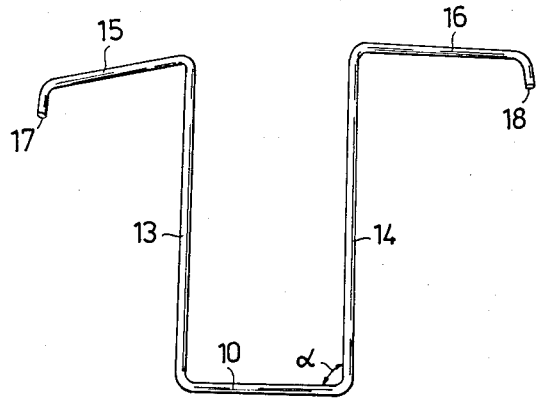
FIG. 3 illustrates a modified carrier part of the device.

FIG. 3 illustrates a carrier part which has been bent to a substantially U-shaped configuration and which may be used to support larger objects, such as an electric drill, wooden mallet or the like.

Figure 4A:
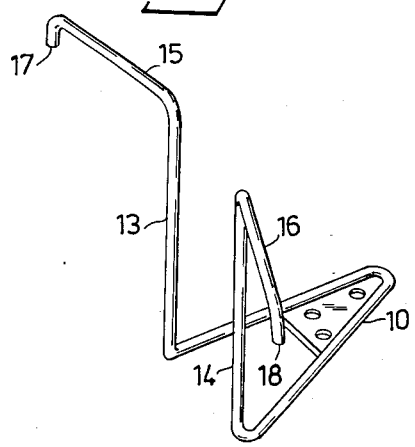
FIGS. 4*a* and 4*b* illustrate further embodiments of the carrier part.
Figure 4B:
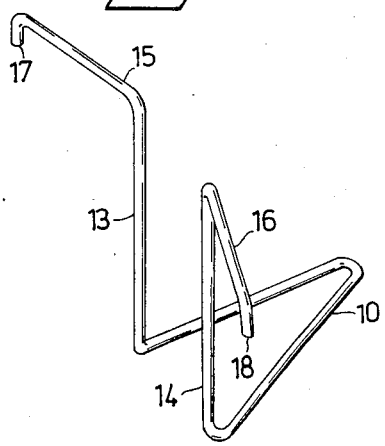

FIGS. 4*a* and 4*b* illustrate alternative configurations of the carrier part. In both of these embodiments, the base parts 10 have been bent to the shape of an an inverted V. In the embodiment of FIG. 4*a*, a perforated plate for accommodating, for example, screwdrivers is located in the apex of the V.

A further advantage afforded by the device according to the invention is that when work is completed it can be removed from the garment or article of clothing and stored until it is next needed, while the garment can be used for other purposes.

I claim:

1. An arrangement for removably attaching an article of clothing to a holder for holding objects, said arrangement comprising:

an intermediate portion having a horizontally positioned holder member and two oppositely positioned connecting members extending substantially perpendicularly from said holder member, said holder member being disposed to receive an object to be held, the connecting members each having a top portion connected to an angular member such that an angle of from 75° to 100° is formed between each connecting member and the respective angle member, the angular members being spaced apart and aligned so that they are substantially oppositely positioned, the holder member, the connecting members, and the angular members being formed from a single predetermined length of material having spring characteristics, and two loop means positioned horizontally apart on the article of clothing such that the longitudinal axes of the loop means are substantially coextensive, and angular members being adapted to being inserted into said loop means.

2. An arrangement according to claim 1, wherein the angle subtended by the holding member and each connecting member is from 75° to 100°.

3. An arrangement according to claim 1, wherein the angle subtended by the holding member and each connecting member is 90°.

4. An arrangement according to claim 1, wherein the holder member comprises a straight rod part.

5. An arrangement according to claim 1, wherein the holder member has a circular arcuate configuration.

6. An arrangement according to claim 5, wherein the holder member and the connecting members form an open sector, the extension of which corresponds to the distance between the angular members and the open sector facing a wearer of said clothing when the device is in position.

7. An arrangement according to claim 1, wherein each said angular member has a free end and the respective free ends are bent downwardly, said bent free ends forming locking means in co-operation with said loop means.

8. An arrangement according to claim 1, wherein the angle subtended by each connecting member and a respective angular member is about 90 °.

9. An arrangement according to claim 1, wherein the material is spring steel.

* * * * *

UNITED STATES PATENT AND TRADEMARK OFFICE

CERTIFICATE OF CORRECTION

PATENT NO. : 4,809,894

DATED : March 7, 1989

INVENTOR(S) : MATTI VIIO

It is certified that error appears in the above-identified patent and that said Letters Patent is hereby corrected as shown below:

Column 5, Claim 1, line 3, "and" should read -- the --.

Signed and Sealed this

Twenty-ninth Day of August, 1989

*Attest:*

DONALD J. QUIGG

*Attesting Officer*

*Commissioner of Patents and Trademarks*